United States Patent [19]

Dimitri

[11] Patent Number: 5,040,726

[45] Date of Patent: Aug. 20, 1991

[54] SOLAR ENERGY POWERED WATER FOUNTAIN

[76] Inventor: Amir T. Dimitri, 18633 Calypso Pl., Gaithersburg, Md. 20879

[21] Appl. No.: 542,960

[22] Filed: Jun. 25, 1990

[51] Int. Cl.[5] ..... B05B 17/08

[52] U.S. Cl. ..... 239/17; 239/18; 239/20; 239/22

[58] Field of Search ..... 239/17, 18, 20, 22, 239/211, 289; 417/415

[56] References Cited

U.S. PATENT DOCUMENTS

| | | | |
|---|---|---|---|
| 1,965,323 | 7/1934 | Taslitt | 239/20 |
| 4,705,216 | 11/1987 | Kaffka et al. | 239/18 |
| 4,744,334 | 5/1988 | McAnally | 417/415 |
| 4,747,538 | 5/1988 | Dunn et al. | 239/289 |
| 4,817,312 | 4/1989 | Fuller et al. | 239/17 |

FOREIGN PATENT DOCUMENTS

| | | | |
|---|---|---|---|
| 3704099 | 9/1988 | Fed. Rep. of Germany | 239/20 |

*Primary Examiner*—Andres Kashnikow
*Assistant Examiner*—Lesley D. Morris
*Attorney, Agent, or Firm*—Donald A. Kettlestrings

[57] ABSTRACT

A solar energy powered water fountain includes a submersible pump submersed within a water-filled container, and a solar panel is removably connected in electrical circuit relationship with the pump for controlling operation of the pump, whereby the amount of water discharged from the pump and the display patterns produced by the pump are directly responsive to variations in light level at the solar panel.

6 Claims, 2 Drawing Sheets

PERFORMANCE CHARACTERISTICS

SOLAR ENERGY POWERED WATER FOUNTAIN

This invention relates to water fountains and more particularly to a solar energy powered water fountain which can be used outdoors or indoors to produce a display that varies in response to the amount of light at a solar panel used to power the fountain.

An object of the present invention is to provide a solar energy powered liquid fountain.

Another object is to provide such a fountain which produces a display directly responsive to variations in light level.

A further object of the invention is the provision of a water fountain which produces a water and light display responsive to variations in light level and temperature at a solar energy panel used to power the fountain.

Still another object is to provide such a fountain which is incorporated into a table.

Yet another object of the present invention is the provision of a solar energy powered water fountain which can be used in combination with a table as an aquarium.

A still further object is to provide such a fountain which can be used in combination with a table to provide a decorative and attractive coffee table.

Another object is to provide such a fountain for use outdoors which produces a display that varies with the intensity of sunlight during the day.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

The accompanying drawings, which are incorporated in and constitute a part of this specification, illustrate examples of preferred embodiments of the invention and, together with the description, serve to explain the principles of the invention.

Figure 1:
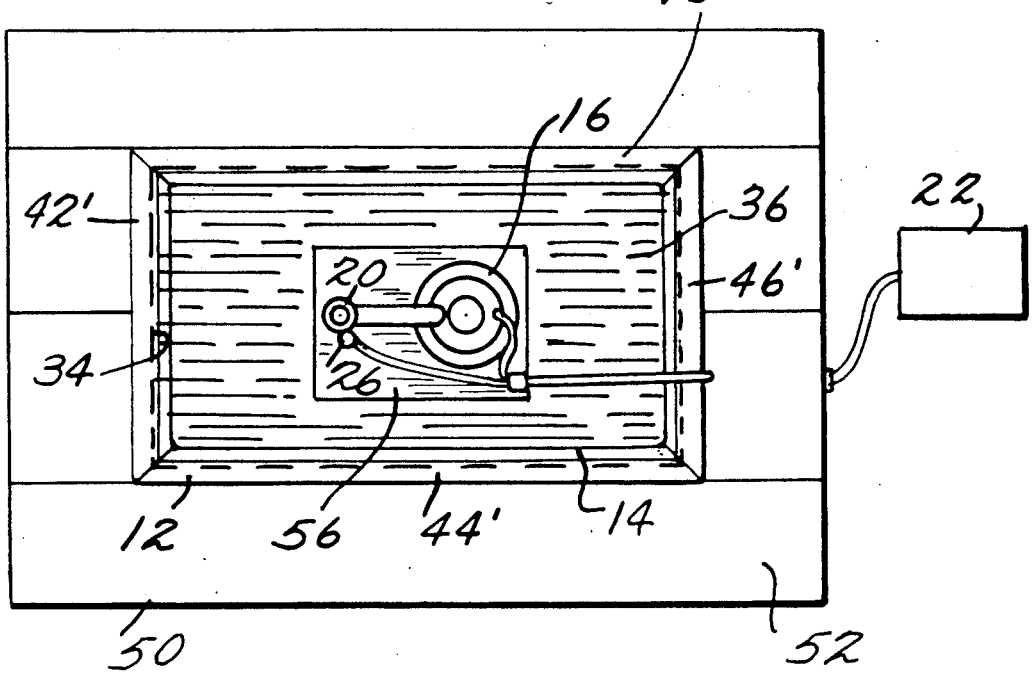
FIG. 1 is a top plan view of the solar powered fountain in use with a table.

With reference now to the drawings, wherein like reference characters designate like or corresponding parts throughout the several views, there is shown in FIG. 1 a solar energy powered water fountain 10 for producing a water display responsive to variations in light level.

Fountain 10 includes a water or liquid container 12. A liquid 14, such as water, at least partially fills container 12. A liquid or water-submersible pump 16 is submersed in liquid 14 in a conventional manner. Pump 16 includes a liquid intake 18 in fluid communication with liquid 14, and pump 16 also includes at least one liquid output or nozzle 20 for discharging the liquid from the pump in predetermined display patterns.

A solar energy panel 22 of conventional configuration is provided for converting light energy to electrical energy. Panel 22 can be positioned at any desirable location with respect to pump 16, and panel 22 is connected in electrical circuit relationship with pump 16 for controlling operation of the pump. As a result, the amount of liquid discharged from pump 16 and the display patterns produced by the pump are responsive to variations in light level and temperature at solar panel 22.

As an example, pump 16 may be an electrical twelve volt direct current centrifugal pump having a pumping capacity at open flow of three hundred sixty gallons per hour. The pump is sealed and, therefore, submersible. The pump may be designed to be used with a three-quarter inch internal diameter pipe, which may form output jet or nozzle 20 for the fountain. The pumping capacity and rate of flow through the pump will be dependent upon the electrical power supplied to the pump, and the pump would draw up to three-quarters of an ampere of current at twelve volts D.C.

Figure 5:
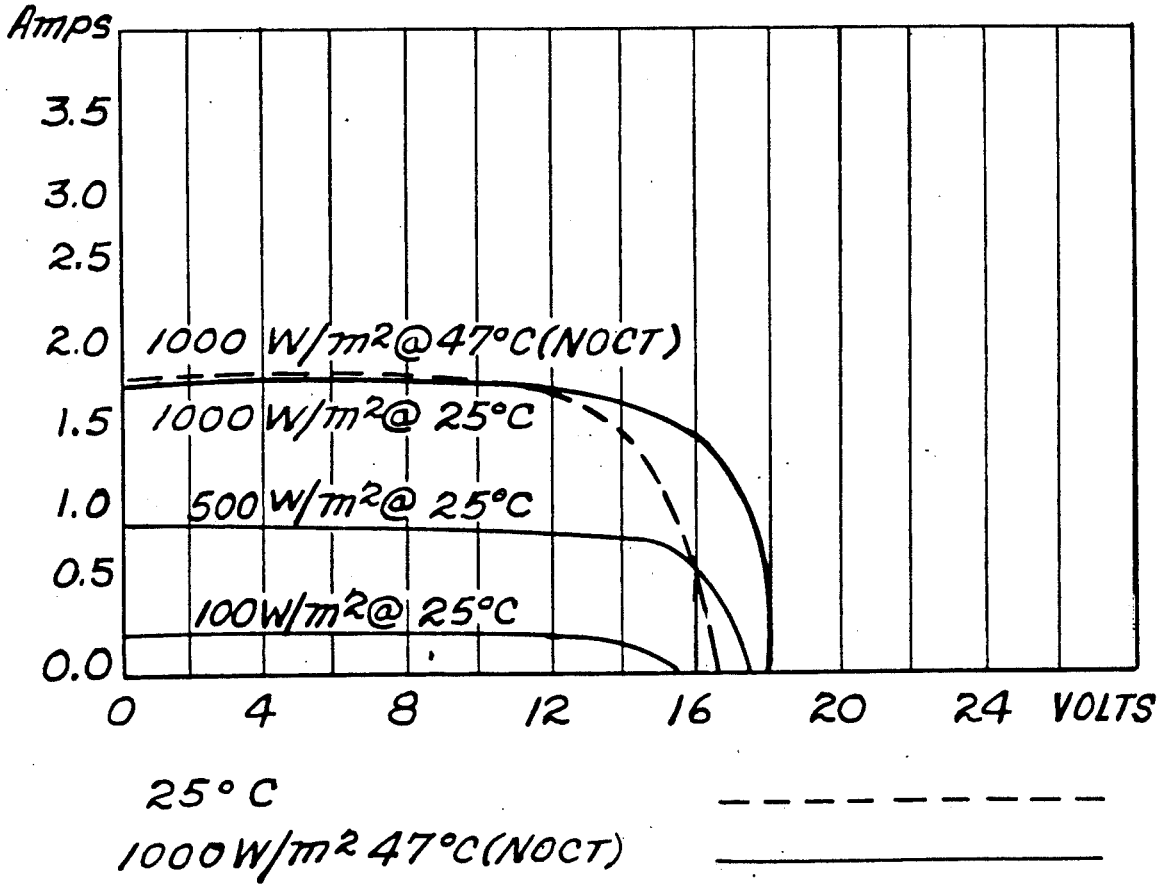
FIG. 5 is a graphical illustration of the performance characteristics of a solar panel which can be used to power the fountain.

Solar panel 22, which generates electricity to drive pump 16, has an electrical power output which varies depending upon the light level and temperature to which it is exposed. The current versus voltage curve shown in FIG. 5 illustrates the typical power response to various light levels at twenty-five degrees Celsius cell temperature within panel 22 and at a normal operating cell temperature (NOCT) of forty-seven degrees Celsius.

In accordance with the invention, a lamp or lamps 26 also are provided in electrical circuit relationship with panel 22. Lamp or lamps 26 are positioned adjacent to pump output or outputs 20 so that the light from the lamp or lamps may be directed onto the fountain spray, whereby the intensity of the illumination from the lamp or lamps varies in response to changes in light level at solar panel 22.

Figure 2:
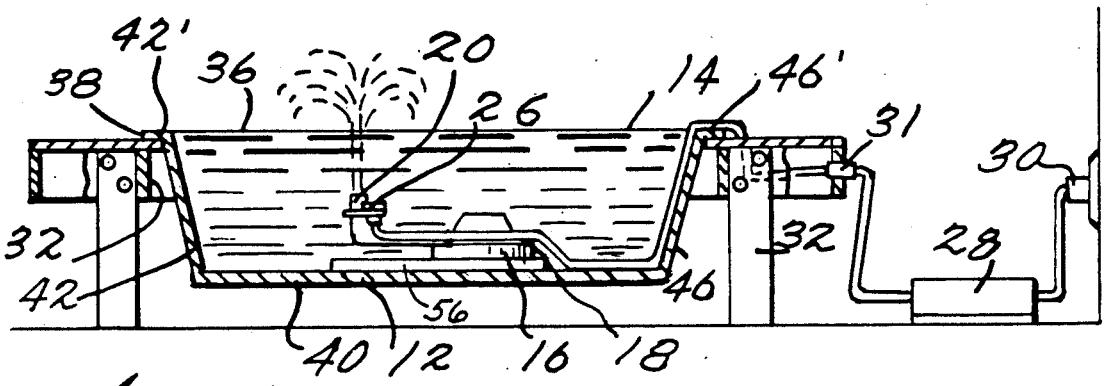
FIG. 2 is a side elevation view, partly in section, showing the fountain and the table of FIG. 1 but wherein the fountain is operated by a source of D.C. electrical power.
Figure 3:
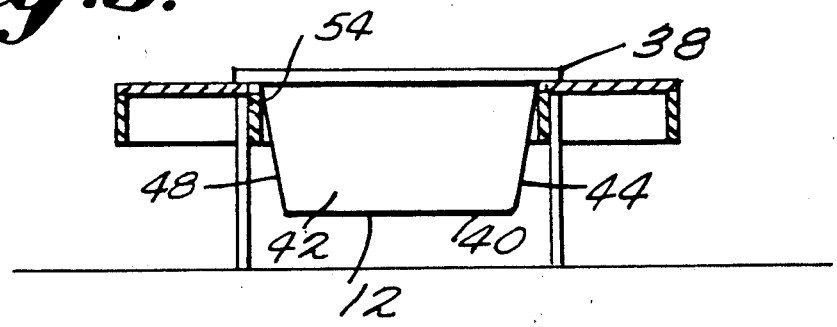
FIG. 3 is an end elevational view, partly in section, of the table shown in FIGS. 1 and 2.
Figure 4:
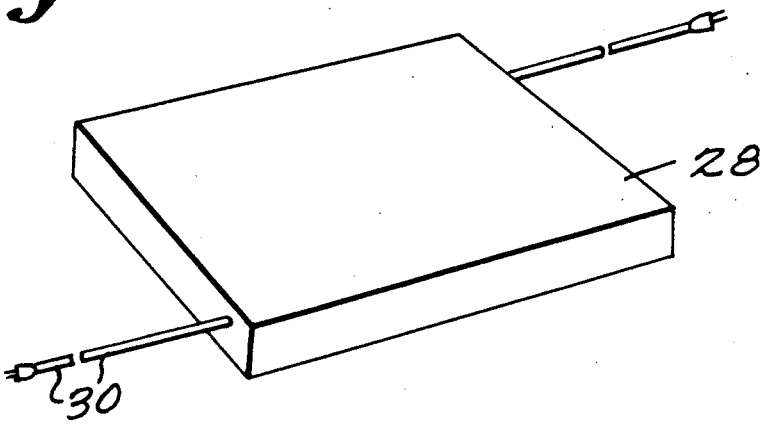
FIG. 4 is a fragmentary perspective view showing an alternative source of D.C. electrical power for the fountain.

A conventional source of D.C. electrical power 28 (FIG. 4) may also be provided with a conventional electrical conductor and connector 30 for removably electrically connecting power source 28 to pump 16 via connector 31 (FIG. 2) when solar panel 22 has been electrically disconnected from pump 16 and from connector 31. This permits pump 16 and fountain 10 to operate independently from variations in light intensity at panel 22.

The fountain, in accordance with this invention, may also be incorporated into a coffee/cocktail table for outdoor or indoor use. More specifically, a supporting assembly 32, in the form of a table, defines an opening 34 for receiving and supporting liquid container 12.

Container 12, in this embodiment, is an open-topped container defining an open upper area 36 adjacent to the free surface of liquid 14 which at least partially fills container 12. Pump 16 is submersed within liquid 14 and is positioned within container 12 so that the liquid display patterns discharged from pump 16 can be projected above the free surface of liquid 14 and above upper limits 38 of container 12.

Container 12 preferably defines a bottom 40, and a plurality of sides 42, 44, 46 and 48 are attached to and project upwardly from bottom 40. Each of the sides defines an upper marginal surface or edge 42', 44', 46', and 48', respectively, in substantially planar alignment with each other.

Table 50 further includes a table top 52 positioned on and preferably attached to supporting assembly 32. Table top 52 defines an opening 54 therein of a size to receive and surround container sides 42, 44, 46 and 48. Table top 52 and upper marginal edges or surfaces 42', 44', 46' and 48' are preferably in substantially planar alignment with each other so that container 12 is substantially fully recessed within table 50 to present a pleasing appearance. Opening 54 is preferably substantially centered within table top 52.

It should be understood that pump 16 and solar panel 22 may be provided with different capacities. Further, coffee/cocktail table 50 can be provided in many different shapes and configurations. Container 12, whether used indoors or outdoors, could be used as an aquarium. Alternatively, container 12 could be used for storing ice cubes and beverages for a party, or container 12 could be used to grow plants.

It should also be understood that various types and numbers of output nozzles or jets 20 can be provided for pump 16. Also, one or more of outputs 20 could include connecting devices for enabling different types of jets to be installed for providing different shapes and configurations of fountain sprays.

Previously known fountains have been powered by A.C. pumps. The fountain described herein uses D.C. solar energy, which is safer, quieter and easier to install in an outdoor garden environment. The power provided by solar panel 22 and by alternate D.C. power source 28 is preferably a safe twelve volts D.C. with a maximum of two amperes. As a result, no danger of electrocution exists.

If output nozzle 20 is properly threaded, container 12 can be quickly and easily cleaned by attaching a conventional garden hose to nozzle 20. The water within container 12 can then be pumped out by activating pump 16, and pump 16 can then be removed from container 12 to permit the container to be scrubbed or hosed for cleaning purposes.

Container 12 is preferably made from a durable plastic material, and pump 16 is preferably mounted onto a supporting base 56 for providing support and stability for the pump as it is positioned within container 12. Base 56 may be comprised of cedar wood, for example, sandwiched between two cork boards to cushion vibrations of pump 16.

The fountain described herein utilizes solar energy to control the rise and fall of the fountain spray in response to variations of sunlight intensity when the fountain is used in an outdoor environment. This creates a natural and ever-changing source of entertainment and quiet relaxation and is a unique way of demonstrating solar energy to the layman. The fountain can also be used indoors to provide a changing and entertaining fountain display.

The invention in its broader aspects is not limited to the specific details shown and described, and departures may be made from such details without departing from the principles of the invention and without sacrificing its chief advantages.

What is claimed is:

1. A solar energy powered liquid fountain for producing a liquid display responsive to variations in light level, said fountain comprising:

an open-topped liquid container defining a bottom and a plurality of sides attached to and projecting upwardly from said bottom, each of said sides defining upper marginal surfaces in substantially planar alignment with each other;

a liquid at least partially filling said container;

a liquid-submersible pump submersed in said liquid;

said pump including a liquid intake in fluid communication with said liquid and at least one liquid output for discharging said liquid from said pump in predetermined display patterns;

a solar panel for converting light energy to electrical energy, said panel removably connected in electrical circuit relationship with said pump for controlling operation of said pump, whereby the amount of said liquid discharged from said pump and the display patterns produced by said pump are responsive to variations in light level at said solar panel; and a supporting assembly, in the form of a table, defining an opening for receiving and supporting said liquid container and wherein said table includes a table top positioned on said supporting assembly.

2. A fountain as in claim 1 wherein said table top defines an opening therein of a size to receive and surround said container sides.

3. A fountain as in claim 2 wherein said table top and said upper marginal surfaces of said sides are in substantially planar alignment with each other, whereby the container is recessed within said table.

4. A fountain as in claim 3 wherein said table top opening is substantially centered within said table top.

5. A fountain as in claim 1 further including a lamp in electrical circuit relationship with said solar panel, said lamp positioned adjacent to said pump output, whereby the intensity of light from said lamp varies in response to variations in light level at said solar panel.

6. A fountain as in claim 1 further including a source of D.C. electrical power and means connected to said D.C. source for removably connecting said D.C. source to said pump when said solar panel has been electrically disconnected from said pump.

* * * * *